US005513614A

United States Patent [19]

Gras et al.

[11] Patent Number: 5,513,614

[45] Date of Patent: May 7, 1996

[54] METHOD FOR FILLING THE FUEL SUPPLY SYSTEM IN AN INTERNAL COMBUSTION ENGINE

[75] Inventors: Juergen Gras, Bietigheim-Bissingen; Eberhard Lang, Erligheim; Klause Franzke, Leonberg, all of Germany

[73] Assignee: Robert Bosch GmbH, Stuttgart, Germany

[21] Appl. No.: 446,681

[22] PCT Filed: Oct. 12, 1994

[86] PCT No.: PCT/DE94/01194

§ 371 Date: Jun. 1, 1995

§ 102(e) Date: Jun. 1, 1995

[87] PCT Pub. No.: WO95/11378

PCT Pub. Date: Apr. 27, 1995

[30] Foreign Application Priority Data

Oct. 21, 1993 [DE] Germany ..... 43 35 891.8

[51] Int. Cl.[6] ..... F02D 41/30; F02D 41/06

[52] U.S. Cl. ..... 123/497; 123/179.17; 123/198 DB

[58] Field of Search ..... 123/495, 497, 123/516, 179.16, 179.17, 198 D, 198 DB

[56] References Cited

U.S. PATENT DOCUMENTS

| | | | |
|---|---|---|---|
| 5,044,344 | 9/1991 | Tuckey et al. | 123/497 |
| 5,179,920 | 1/1993 | Bender | 123/198 DB |
| 5,179,922 | 1/1993 | Bartholomew | 123/198 DB |
| 5,291,578 | 3/1994 | Kalami | 123/497 |
| 5,293,299 | 3/1994 | Iwabuchi et al. | 123/497 |
| 5,313,923 | 5/1994 | Takeuchi et al. | 123/198 DB |
| 5,345,915 | 9/1994 | Schmitz-Huebsch | 123/497 |

*Primary Examiner*—Thomas N. Moulis
*Attorney, Agent, or Firm*—Michael J. Striker

[57] ABSTRACT

A description is given of a method for filling the fuel supply system in an internal combustion engine, in which the fuel pump is activated by the control unit. If the control unit recognizes, as a function of measured variables, that filling with fuel should take place, it activates the fuel pump in a manner such that a sufficient filling of fuel is already obtained before the internal combustion engine starts. If, on the other hand, the control unit recognizes a normal start, the customary method for controlling the electric fuel pump is executed. The time control of the electric fuel pump is changed over to normal activation also as a function of recognized termination conditions.

10 Claims, 1 Drawing Sheet

METHOD FOR FILLING THE FUEL SUPPLY SYSTEM IN AN INTERNAL COMBUSTION ENGINE

PRIOR ART

The invention starts from a method for filling the fuel supply system in an internal combustion engine in accordance with the generic type of the main claim.

In fuel supply systems of internal combustion engines the electric fuel pump is usually activated with the aid of the control unit. On starting-up, the fuel pump operates as long as the control unit recognizes that the starter switch is actuated. If the engine has started running, the pump remains switched on. A protective circuit avoids the delivery of fuel when the ignition is switched on and the engine is dead, for example after an accident.

After a repair or after an injection system has been installed in a motor vehicle, the fuel circuit of the internal combustion engine has to be refilled. This filling should take place without starting the internal combustion engine in order to prevent catalyst damage due to lean combustion at the beginning of operation of the internal combustion engine.

Since, however, prolonged operation of the fuel pump without starting the internal combustion engine or without it being in operation should be avoided so that, in the event of an accident, the escape of relatively large amounts of fuel, for example from burst fuel lines, is avoided, an operation of this type has to be prevented. Furthermore, such an operating restriction is selected so that, when the ignition is switched on, accidents, for example due to fuel lines not being connected after repairs to the fuel circuit, are prevented.

The object of the invention consists in implementing these two inherently contradictory demands of a desired, long pump preliminary operation time for filling the circuit and a short pump preliminary operation time in normal operation without costly and complex intervention in the control system of the internal combustion engine being required.

Advantages of the Invention

The method, according to the invention, with the features of claim 1 has the advantage that reliable filling of the fuel circuit of the internal combustion engine is achieved without starting of the internal combustion engine being required. It is furthermore ensured that, on normal starting of the internal combustion engine, a short preliminary operation time of the fuel pump is obtained and, at the same time, it is ensured that, in the event of an accident, the delivery of fuel is rapidly stopped, so that inadvertent escape of fuel is avoided.

These advantages are achieved by the control device, which carries out the activation of the electric fuel pump, recognizing, from measured variables such as, for example, rotational speed of the internal combustion engine, throttle-valve angle, position of the ignition switch, whether the start is normal or whether filling of the fuel supply system of the internal combustion engine should take place.

In addition, it is ascertained whether the engine temperature and initial air temperature are approximately the same and are within a certain range (for example 20°–30° C.).

As a function of this recognition, the control device advantageously implements either a normal activation of the electric fuel pump or a time control of the electric fuel pump.

This time control can be terminated in a particularly advantageous manner by the control unit when specifiable conditions occur and a transfer to the normal activation of the electric fuel pump can take place.

By evaluation of the throttle-valve position unambiguous conditions can be realized, using which the control device can reliably recognize which operation is desired. If the desire for "filling of the system" has been recognized, then a repeated filling of the system is no longer possible.

Further advantages of the method according to the invention are achieved by the measures specified in the subclaims.

DRAWING

The invention is illustrated in the drawing and is explained in more detail in the description which follows. In the drawing, FIG. 1 shows a rough overview of the fuel supply system of all internal combustion engine including the means, essential to the invention, for detecting operating states. FIG. 2 illustrates a voltage-time diagram for various signals.

DESCRIPTION OF THE EXEMPLARY EMBODIMENT

Figure 1:
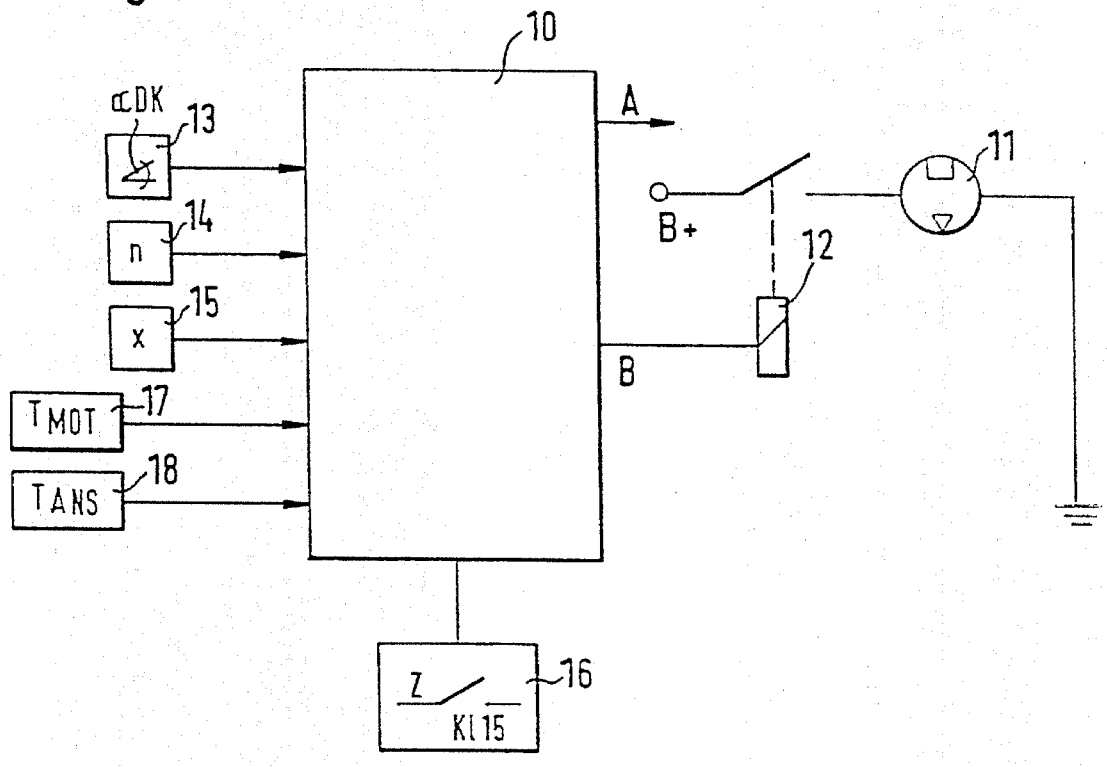

FIG. 1 illustrates schematically those components of a fuel supply system of an internal combustion engine which are required for explaining the invention. The control device, i.e., for example, the control unit of a motor vehicle, is designated by 10. This control unit 10 activates, inter alia, the electric fuel pump 11, this activation taking place with the aid of the electric fuel pump relay 12, one connection of which is connected to the battery voltage terminal B+.

The items of information delivered by sensors or other measuring means are fed to the control unit. Sensors or measuring means, not all of which, however, necessarily have to be present, are specified as being: a throttle-valve sensor 13 which measures the angle of the throttle valve αDK, a rotational-speed sensor 14, in addition an engine-temperature sensor 17 and also an initial-air temperature sensor 18, any other sensor 15 and a voltmeter 16 which measures the voltage at terminal K1.15 and, as a result, recognizes whether the ignition switch Z is open or closed.

The data determined by the sensors and the voltmeter are fed to the control unit 10 and are evaluated in the latter for the purpose of control or regulation of the internal combustion engine, for example of the ignition or injection, and the signals are emitted by the control unit 10 at the output A. Furthermore, the control unit 10 supplies at an output B, as a function of the items of information fed to it or of the recognized operating parameters, activating signals for the relay 12 which applies voltage to the electric fuel pump 11 or disconnects it therefrom.

Figure 2:
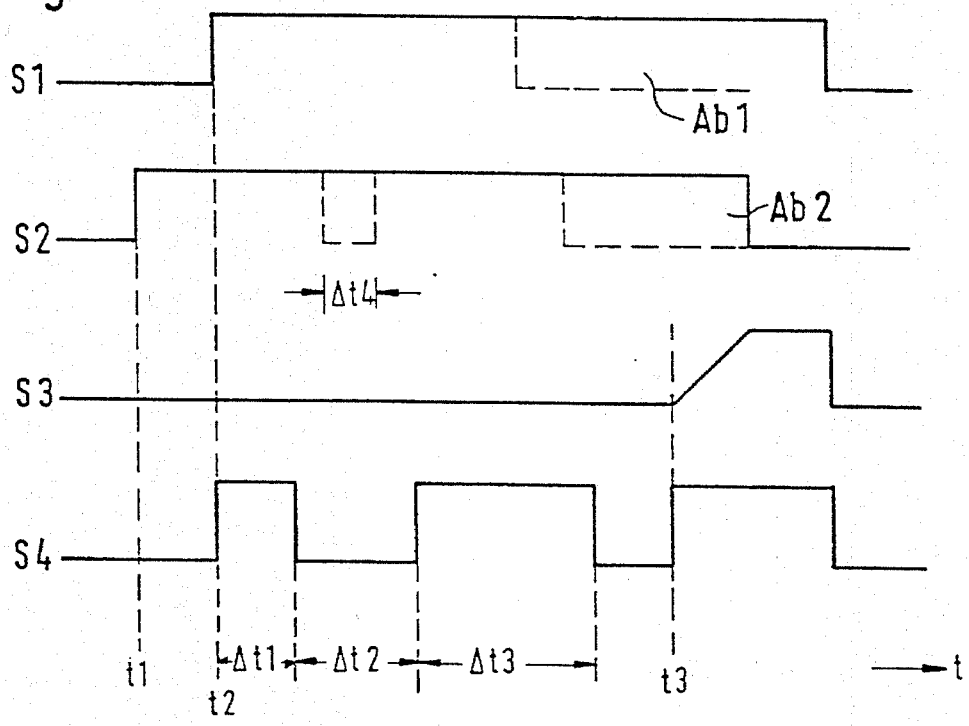

FIG. 2 plots the signals which are essential for understanding the invention. These signals are voltage waveforms over time t. In detail, an illustration is given of the signal to terminal K1.15 which is a measure of whether the ignition switch is switched on or off. This signal is designated by S1. S2 designates the outputs signal of the throttle-valve sensor 13. It is low if the throttle-valve angle αDK lies below a limit angle and high if it lies thereabove.

The rotational-speed signal S3 is low until the internal combustion engine starts at the time ts, and the signal S4, which constitutes the activating signal for the electric fuel pump 12, which activating signal is emitted by the control unit 10, is low when the electric fuel pump is switched off and high when the fuel pump is switched on.

The signal waveforms illustrated in FIG. 2 are produced if the control unit has recognized that the system should be filled with fuel. Initially, the time control of the electric fuel pump then operates, which time control takes place, in the example of FIG. 2, between t1 and t3. Subsequently, the transfer to normal activation of the electric fuel pump takes place, of which transfer the individual transfer criteria will be described more precisely in the following.

The method described is thus only executed if the control unit has been recently obstructed or if extinguishing of the adaptation values took place, i.e. in the case of a so-called original start. Such an original start is carried out after every relatively major repair to the injection system.

The differentiation of the driver's requirement for filling of the fuel circuit or normal starting of the vehicle is carried out in the control unit by evaluating the position and movement of the throttle valve. If, before the ignition is switched on, the throttle valve is opened wide, for example over a throttle-valve angle αDK of 80°, the normal pump preliminary operation is initially executed, which lasts for approximately Δt1=1 second. In FIG. 2, t1 designates the beginning of the deflection of the throttle valve. At the time t2, the ignition switch Z is closed and simultaneously the electric fuel pump relay 12 is closed for the first time. If after, for example, one second (Δt1) the throttle valve is still kept open (signal S2 remains high), there takes place, after a defined period of time Δt2, a further, longer activation of the pump, which amounts to approximately 20 seconds and is designated in FIG. 2 by Δt3. This time is sufficient for filling the fuel circuit.

To begin the time control of the electric fuel pump the following conditions have to be met: The rotational speed must be n=0 and the throttle-valve angle αDK must be larger than 80° before voltage is applied to terminal K1.15. In addition, the condition: engine temperature TMOT is approximately equal to the induction air temperature TANS, can be set. Furthermore, recognition of an original start has to take place and subsequently voltage has to be applied to terminal K1.15. The time control of the electric fuel pump is only operated if all these conditions are met.

A further criterion for beginning the time control can lie in the fact that it is recognized whether the throttle-valve angle becomes equal to zero after a specifiable period of time after the preliminary operation of the fuel pump.

A refinement of this procedure can be achieved by virtue of the fact that, after the first pump preliminary operation, the driver has to completely close and reopen the throttle valve once so that it is recognized that filling is desired. The signal waveform of S2 which is then produced is indicated by broken lines, the period of time during which the throttle valve is closed is designated by Δt4. The temporal coordination of the throttle-valve movement is easily possible for the mechanic in the workshop or on the assembly line because of the noise of the fuel pump.

Under certain conditions, for example if the rotational speed becomes greater than 0, if the throttle valve angle becomes smaller than 80° or if the voltage at terminal K1.15 drops, i.e. if the ignition switch Z is opened, the transfer to the normal activation of the electric fuel pump or to switching-off of the electric fuel pump takes place.

The transfer from the time control to the normal activation of the electric fuel pump according to t3, i.e. when start-up begins, takes place in the case of a normal start. The other termination criteria intervene in the event of an error or an accident.

If the control unit recognizes that filling is not required, but rather that normal operation should take place, rather than initiating time control of the electric fuel pump, the normal operation is immediately executed, in which, although a pump preliminary operation is executed for a time of approximately one second, the next activation of the electric fuel pump takes place only after a recognized increase in rotational speed at t3.

The signals S1 and S2 may optionally be prematurely low, this leads to termination of the time control of the electric fuel pump, the signal waveforms are shown by broken lines, the associated termination conditions are designated by Ab1 and Ab2, respectively.

We claim:

1. A method for filling the fuel supply system in an internal combustion engine, with a fuel pump which is operated by means of a control device, and with means for detecting operating states of the internal combustion engine, which means emit corresponding output signals, in particular relating to the position of the throttle valves, the ignition switch or the rotational speed, wherein, when the fuel pump is activated, a differentiation is made between a normal start and filling of the fuel supply system and the differentiation is carried out by the control device as a function of detected operating states.

2. The method as claimed in claim 1, wherein the control device is the control unit of the internal combustion engine.

3. The method as claimed in claim 1, wherein the operating parameters are the position of the throttle valve and the position of the ignition switch, an evaluation being carried out as to whether the associated signals are high or low.

4. The method as claimed in claim 3, wherein further operating parameters are the engine temperature and/or the air temperature.

5. The method as claimed in claim 4, wherein the engine temperature and/or the air temperature have to lie within a defined range in order to recognize desired filling of the system with fuel.

6. The method as claimed in claim 1, wherein the waveform of the output signals of the means for detecting the position of the throttle valve and ignition switch is evaluated over time and, as a function of this time variation, a normal start or the desired filling of the system with fuel is recognized.

7. The method as claimed in claim 6, wherein, when it is recognized that filling is desired, a time control of an electric fuel pump is activated, which time control additionally activates the fuel pump for a specifiable period before the internal combustion engine starts.

8. The method as claimed in claim 5, wherein, on recognition that the rotational speed is becoming greater than zero, transfer to the normal activation of the electric fuel pump is initiated by the control unit.

9. The method as claimed in claim 6, wherein, on recognition that the voltage $U_{K1.15}$ at the terminal K1.15, which is allocated to the ignition switch, is becoming low or that the throttle-valve angle $\alpha_{DK}$ is becoming lower than a specifiable threshold value, the time control of the electric fuel pump is terminated by the control unit SG.

10. The method as claimed in claim 1, wherein, after system filling has been recognized, further system filling is suppressed, so that no further time control of the electric fuel pump is activated.

* * * * *